US008228354B2

(12) United States Patent
Yoshida et al.

(10) Patent No.: US 8,228,354 B2
(45) Date of Patent: Jul. 24, 2012

(54) DISPLAY CONTROL DEVICE WITH FRAME RATE CONTROL

(75) Inventors: Tetsuya Yoshida, Kyoto (JP); Atsushi Murayama, Kyoto (JP); Toshio Nishimura, Kyoto (JP); Yohei Ishimaru, Kyoto (JP)

(73) Assignee: Rohm Co., Ltd. (JP)

( * ) Notice: Subject to any disclaimer, the term of this patent is extended or adjusted under 35 U.S.C. 154(b) by 408 days.

(21) Appl. No.: 12/521,652

(22) PCT Filed: Dec. 27, 2007

(86) PCT No.: PCT/JP2007/001487
§ 371 (c)(1),
(2), (4) Date: Jun. 29, 2009

(87) PCT Pub. No.: WO2008/081594
PCT Pub. Date: Jul. 10, 2008

(65) Prior Publication Data

US 2010/0309235 A1 Dec. 9, 2010

(30) Foreign Application Priority Data

Dec. 28, 2006 (JP) ..... 2006-356291

(51) Int. Cl.
*G09G 5/10* (2006.01)

(52) U.S. Cl. ..... 345/690; 345/89

(58) Field of Classification Search ..... 345/89, 345/596, 589, 690, 691
See application file for complete search history.

(56) References Cited

U.S. PATENT DOCUMENTS

| | | | | |
|---|---|---|---|---|
| 6,353,435 | B2 * | 3/2002 | Kudo et al. | 345/204 |
| 7,209,142 | B1 * | 4/2007 | Agano | 345/589 |
| 7,612,751 | B2 * | 11/2009 | Lee | 345/89 |
| 7,911,431 | B2 * | 3/2011 | Jung | 345/89 |
| 2001/0028346 | A1 | 10/2001 | Kudo et al. | |
| 2002/0036603 | A1 * | 3/2002 | Nagakubo et al. | 345/60 |
| 2002/0135604 | A1 * | 9/2002 | Yoneyama | 345/690 |
| 2003/0184569 | A1 * | 10/2003 | Koga et al. | 345/690 |
| 2005/0110796 | A1 * | 5/2005 | Flowers et al. | 345/589 |

FOREIGN PATENT DOCUMENTS

JP 2003-302955 * 10/2003

OTHER PUBLICATIONS

International Preliminary Report on Patentability for International Application No. PCT/JP2007/001487 issued Jul. 7, 2009 with English translation.
Chinese Office Action for Chinese patent application No. 200780005954.X mailing date of Mar. 12, 2012 with English Translation.

* cited by examiner

*Primary Examiner* — Chanh Nguyen
*Assistant Examiner* — Roy Rabindranath
(74) *Attorney, Agent, or Firm* — Cantor Colburn LLP

(57) ABSTRACT

A display control device uses frame rate control, and converts m-bit input data (m is an integer) representing brightness of each pixel, to n-bit output data (n is an integer, n<m), to control brightness of each pixel. A first frame rate controller generates a plurality of first tone data according to the input data, and outputs the generated data in a time division manner for each predetermined first timing. A second frame rate controller generates a plurality of second tone data according to the input data, and outputs the generated data in a time division manner for each predetermined first timing. Rate of change of brightness represented by the first tone data with respect to the input data, and rate of change of brightness represented by the second tone data with respect to the input data are made different.

37 Claims, 8 Drawing Sheets

100a

| INPUT TONE VALUE D_IN | APPEARANCE RATIOBRIGHTNESS 62 : BRIGHTNESS 63 | AVERAGE BRIGHTNESS COMPUTATION FORMULA | 8-BIT CONVERSION AVERAGE BRIGHTNESS |
|---|---|---|---|
| 246 | – | – | 246 |
| 247 | – | – | 247 |
| 248 | – | – | 248 |
| 249 | 3:1 (CONVENTIONAL FRC PART) | (62*3+63*1)/4=62.25 | 249 |
| 250 | 5:3 〃 | (62*5+63*3)/8=62.375 | 249.5 |
| 251 | 4:4 〃 | (62*4+63*4)/8=62.5 | 250 |
| 252 | 3:5 〃 | (62*3+63*5)/8=62.625 | 250.5 |
| 253 | 2:6 〃 | (62*2+63*6)/8=62.75 | 251 |
| 254 | 1:7 〃 | (62*1+63*7)/8=62.875 | 251.5 |
| 255 | 0:8 〃 | (62*0+63*8)/8=63 | 252 |

DISPLAY CONTROL DEVICE WITH FRAME RATE CONTROL

BACKGROUND OF THE INVENTION

1. Field of the Invention

The present invention relates to a display control device which outputs data exhibiting brightness of each pixel, to a display panel on which a plurality of pixels are arrayed, and in particular relates to frame rate control technology.

2. Description of the Related Art

A matrix-type display device such as a liquid crystal panel or the like, is configured by providing a plurality of pixels arrayed in a matrix form, and an image is displayed by the whole display device by making each pixel emit light at a desired brightness. Here, in order to make a pixel emit light, it is necessary to give an electrical signal, for example, voltage or current, corresponding to emitted light brightness, to the pixel. A driver circuit provides an electrical signal according to tone, to each pixel, based on an inputted m-bit multi-tone signal.

On the other hand, there are cases in which pixel data generated by computational processing means such as a graphics processor, a CPU (Central Processing Unit), or the like, are represented by a number of tones, m-bit, larger than n-bit that the driver circuit is capable of representing.

For example, a typical liquid crystal driver, used in a laptop personal computer or the like, receives a brightness signal of n=6-bit tones for each RGB (Red, Green, Blue) color, and drives pixels based on this. In contrast to this, there are cases in which image data is represented by m=8-bit tones for each color.

In such cases, in order to represent tones ($2^m$) exceeding the number of tones ($2^n$) that the driver circuit is capable of representing, technology known as frame rate control (referred to as FRC below) is used. In FRC a plurality of data, obtained by the upper n-bits being adjusted, in accordance with the lower (m-n) bits of brightness data, are generated, and the plurality of data undergoes time division to be outputted. In this way, even in cases in which an n-bit driver circuit is used, it is possible to represent brightness of pixels by approximately m-bit multi-tones in a simulated manner. For example, related technology is disclosed in Patent Document 1.

Patent Document 1: Japanese Patent Application, Laid Open No. H2003-302955

Using FRC, it is possible to represent more tones than $2^n$ tones that a driver circuit is capable of representing. For example, in cases where m=8-bit and n=6-bit, if 4 frames are used to implement FRC, representation of $2^n-3=253$ tones is possible for each color, and $253^3 \approx 16{,}200{,}000$ colors can be represented by a pixel. However, image data itself is represented by 8-bit 256 tones for each color, and since a pixel is represented by $256^3 \approx 16{,}770{,}000$ colors, there is a problem in that about 600,000 colors cannot be represented.

SUMMARY OF THE INVENTION

The present invention has been made in view of these problems and a general purpose thereof is to improve tone representation by FRC.

An embodiment of the present invention relates to a display control device which uses frame rate control and converts m-bit input data (m is an integer) representing brightness of each pixel, to n-bit output data (n is an integer, n<m), to control brightness of each pixel. The display control device is provided with a first frame rate controller which generates a plurality of data obtained by the upper n-bits of input data being adjusted, according to values of the lower k (k=m−n) bits of the input data, and outputs the generated data in a time division manner at each predetermined first timing, and a second frame rate controller which generates a plurality of data obtained by the upper n-bits of input data being adjusted, according to values of the lower k bits of the input data, and outputs the generated data in a time division manner at each predetermined first timing. A rate of change, that is, a gradient (ΔD_OUT1/ΔD_IN), of brightness represented by first output data D_OUT1 from the first frame rate controller with respect to input data D_IN, and a rate of change (ΔD_OUT2/ΔD_IN) of brightness represented by second output data D_OUT2 from the second frame rate controller with respect to the input data D_IN are made different by the display control device, which selects any of the first or the second output data from the first or the second frame rate controller, to control brightness of each pixel.

According to this embodiment, by providing the two frame rate controllers having different rates of change of the output data with respect to the input data, and selecting either of them to be used, it is possible to improve tone representation.

The display control device of an embodiment may select any of the first and the second output data of the first and the second frame rate controllers, according to a relationship of input data value and a predetermined threshold.

In such cases, the rate of change can be set according to input data range.

In an embodiment, the first timing may be prescribed by a frame signal. In such cases, data may be switched for each single frame signal, or data may be switched for each plurality of frame signals.

In an embodiment, the first frame rate controller may generate the first output data so that the rate of change of the brightness represented by the first output data D_OUT1 with respect to the input data D_IN is 1, and the second frame rate controller may generate the second output data so that the gradient of the brightness represented by the second output data with respect to the input data is less than 1.

By making the rate of change of the output data of the second frame rate controller less than 1, m-bit input data are used more efficiently and multi-tone representation is possible.

The first frame rate controller may include a first frame rate control circuit which generates $2^k$ items of data, obtained by the upper n bits of the input data being adjusted, according to values of the lower k bits of the input data, and outputs the generated data in a time division manner with $2^k$ times as 1 cycle. In such cases, the first output data can be increased at a ratio of 1:1 with respect to the input data, and the rate of change can be made 1.

The second frame rate controller may include a fixed data generator which generates $2^k$ items of n-bit fixed data, representing a first predetermined value d (d is an integer), and outputs the generated fixed data in a time division manner with $2^k$ times as 1 cycle, a second frame rate control circuit which generates $2^k$ items of data, obtained by the upper n bits of intermediate data being adjusted, according to values of the lower k bits of the intermediate data, obtained by a predetermined operation being carried out on the input data, and outputs the generated data in a time division manner with $2^k$ times as 1 cycle, and a selector which receives third output data from the second frame rate control circuit and fixed data from the fixed data generator, to be switched in a time division manner and outputted.

In such cases, since the n-bit fixed value and the upper n bits of the intermediate data are outputted in a time division manner, it is possible to represent a tone that is intermediate between the fixed value and the intermediate data, and consequently it is possible to set the gradient of the second output data with respect to the input data to be less than 1.

The predetermined operation may be addition or subtraction of a second predetermined value f (f is an integer).

With m=8, n=6, and k=2, and a first predetermined value d=252, the predetermined operation may be subtraction of the second predetermined value f=3.

In such cases the second output data of the second frame rate controller passes through a value 255 of the input data and a value 252 of the output data, and it is possible to represent brightness with a gradient less than 1.

The selector may alternately switch the third output data and the fixed data, at each predetermined second timing. In such cases the rate of change of the second output data with respect to the input data can be set to ½.

The second timing may be prescribed by a frame signal.

The second frame rate controller may divide a plurality of pixels arrayed in a matrix form into a plurality of regions, and may set a phase for switching the third output data and the fixed data for each region.

In an embodiment, the first and the second frame rate controllers may be configured to share an intermediate data generator which generates intermediate data obtained by a predetermined operation being carried out on the input data, a selector which outputs a first predetermined value d (d is an integer) and the intermediate data in a time division manner, and one frame rate control circuit to which either one of the input data or the output data of the selector are inputted as third data, to generate a plurality of data obtained by the upper n bits of the third data being adjusted, according to a value of the lower k bits of the third data, and output the generated data in a time division manner at each predetermined first timing. The first and the second frame rate controllers may operates as the first frame rate controller when the input data is inputted to the frame rate control circuit, and as the second frame rate controller when the output data of the selector is inputted to the frame rate control circuit.

In such cases, by switching input of one frame rate control circuit, it is possible to generate two sets of output data having different rates of change with respect to the input data, using one frame rate control circuit.

The predetermined operation may be addition or subtraction of the second predetermined value f (f is an integer).

With m=8, n=6, and k=2, and the first predetermined value d=252, the predetermined operation may be subtraction of the second predetermined value f=3.

The display control device of an embodiment may be integrated as a unit on one semiconductor substrate. "Integrated as a unit" includes cases in which all component elements of the circuit are formed on the semiconductor substrate, and cases in which main component elements of the circuit are integrated as a unit, and some resistors, capacitors, or the like, for adjusting a circuit constant may be arranged outside the semiconductor substrate.

Another embodiment of the present invention relates to an electronic device. The electronic device is provided with a display panel on which pixels are arrayed in a matrix form, a driver circuit which drives the display panel, a signal processor which generates image data to be displayed on the display panel with m bits for each color, and the display control device according to any of the abovementioned embodiments, which receives the m-bit image data and outputs n-bit output data to a driver circuit.

According to this embodiment, it is possible to drive the display panel with multiple tones, effectively using the m-bit data.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIGS. 5A to 5D are diagrams showing operation of a second frame rate controller of each pixel region;

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

Figure 1:
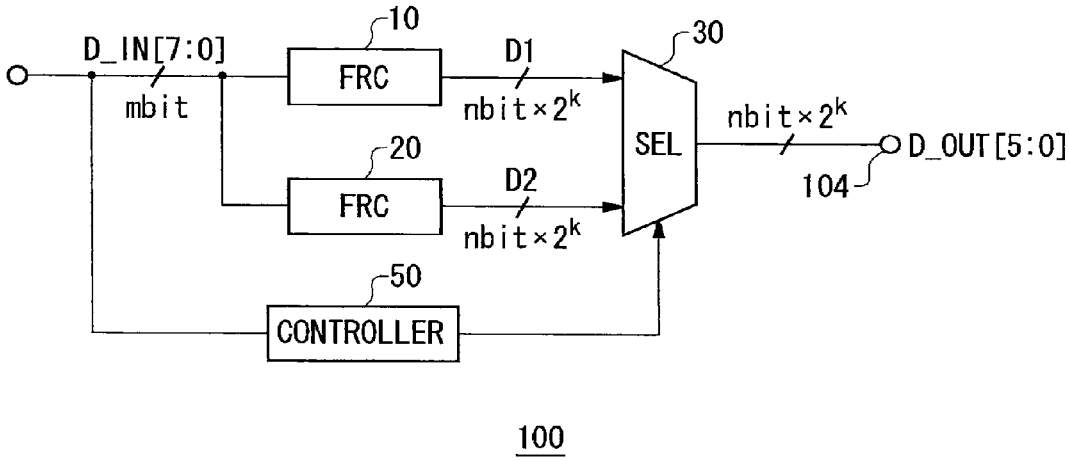
FIG. 1 is a block diagram showing a configuration of a display control device according to an embodiment of the present invention.
Figure 2:
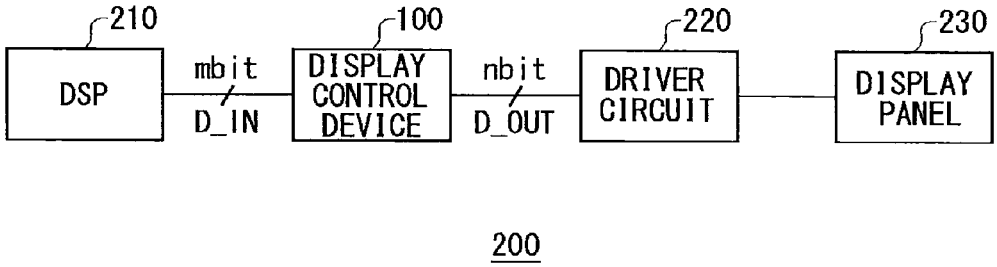
FIG. 2 is a block diagram showing a configuration of an electronic device in which the display control device of FIG. 1 is installed.

FIG. 1 is a block diagram showing a configuration of a display control device 100 according to an embodiment of the present invention. FIG. 2 is a block diagram showing a configuration of an electronic device 200 in which the display control device 100 of FIG. 1 is installed. The electronic device 200 is provided with the display control device 100, a DSP (Digital Signal Processor) 210, a driver circuit 220, and a display panel 230. The electronic device 200 is a laptop personal computer, a mobile telephone, a PDA (Personal Digital Assistance), or the like, provided with the display panel.

The display panel 230 is provided with a plurality of pixels arrayed in a matrix form, for example, a liquid crystal panel. The driver circuit 220 receives n-bit brightness data representing brightness of each pixel, and drives the display panel 230. The DSP 210 generates image data to be displayed on the liquid crystal panel 230 with brightness of each RGB of each pixel as m bits. The DSP 210 outputs the image data to the display control device 100. The display control device 100 receives the m-bit input brightness data (below, referred to simply as input data D_IN) for each color of RGB. The display control device 100 performs frame rate control, and converts the m-bit input data D_IN to n-bit output data D_OUT. The display control device 100 may include a so-called timing-controll circuit. The timing-control circuit generates a horizontal synchronization signal and a vertical synchronization signal, and, synchronously with these, outputs RGB output data of each pixel to the driver circuit 220.

A differential signal may be used in data transfer between the DSP 210 and the display control device 100. In the same way, a differential signal may be used in data transfer between the driver circuit 220 and the display control device 100.

Returning to FIG. 1, an explanation will be given concerning configuration of the display control device 100 according to the embodiment. The display control device 100 uses frame rate control (FRC), and converts m-bit (m is an integer) input data representing brightness of each pixel (that is, each RGB), to n-bit (n is an integer, n<m) output data D_OUT, to control brightness of each pixel. Furthermore, in the present embodiment, a pixel means a sub-pixel for each RGB. In the explanation below, m=8 and n=6.

The display control device 100 is provided with a first frame rate controller 10, a second frame rate controller 20, a selector 30, and a controller 50.

The first frame rate controller 10 uses frame rate control to generate a plurality of first tone data D1 according to the input data D_IN, and outputs the generated data in a time division manner at each predetermined first timing. In addition, the second frame rate controller 20 uses frame rate control to generate a plurality of second tone data D2 according to the input data D_IN, and outputs the generated data in a time division manner at each predetermined first timing. The predetermined first timing is prescribed by a frame signal.

The plurality of first tone data D1 outputted in a time division manner represents, in a simulated manner, by a time average thereof, brightness represented by the input data D_IN. Second tone data D2 is similar.

In the display control device 100 according to the present embodiment, a rate of change g1 (=ΔD1/ΔD_IN) of brightness represented by the first tone data D1 with respect to the input data D_IN, and a rate of change g2 (=ΔD2/ΔD_IN) of brightness represented by the second tone data D2 with respect to the input data D_IN are made different.

The selector 30 receives the first tone data D1 and the second tone data D2 from the first frame rate controller 10 and the second frame rate controller 20, selects and outputs any of them as output data D_OUT, and controls brightness of each pixel. The input data D_IN is inputted to the controller 50, and any of the first tone data D1 and the second tone data D2 from the first frame rate controller 10 and the second frame rate controller 20 is selected and outputted, according to a relationship of a value of the input data D_IN and a predetermined threshold.

Figure 4:
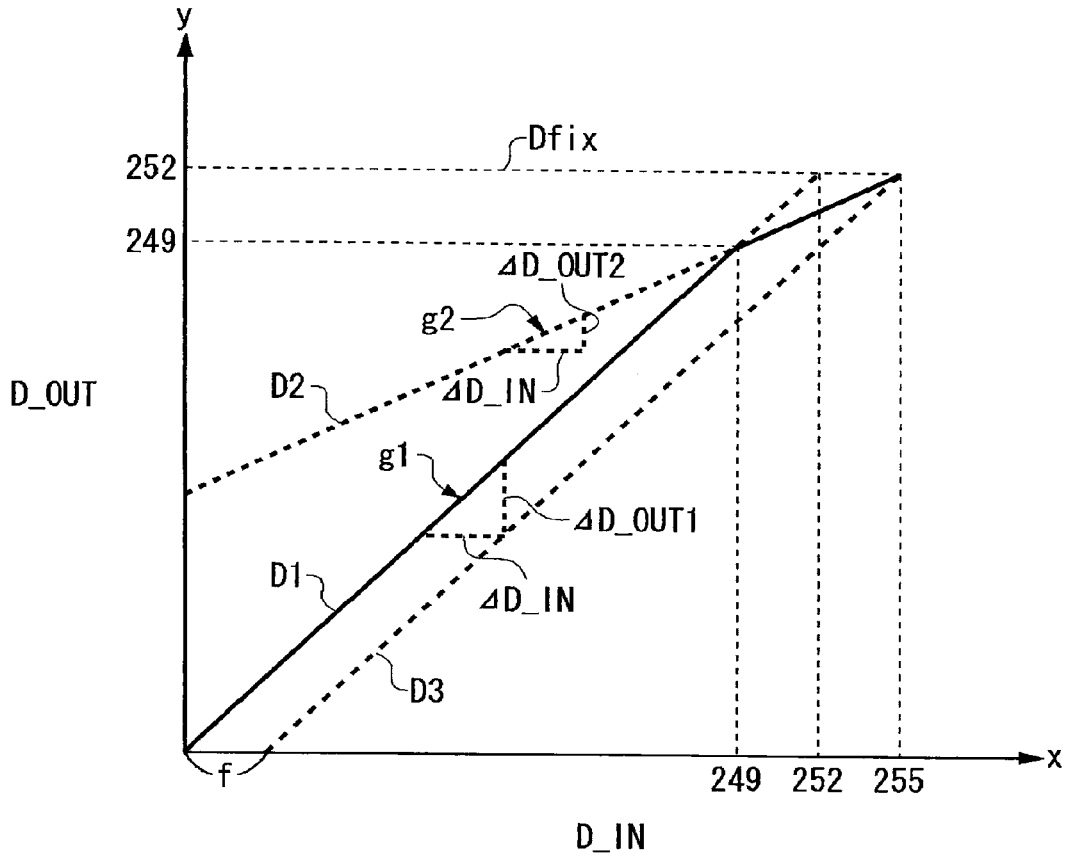
FIG. 4 is a diagram showing relationships of various data in the display control device with input data D_IN.
Figure 5A:
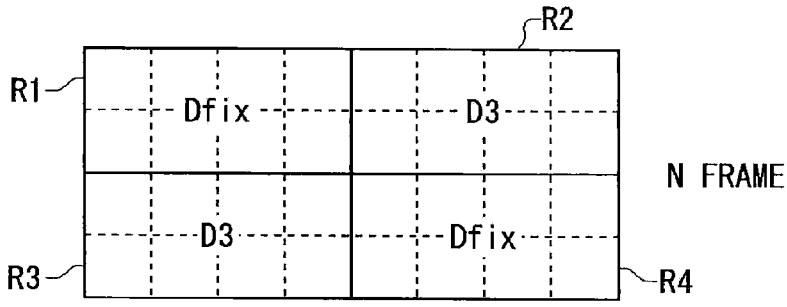
Figure 5A:
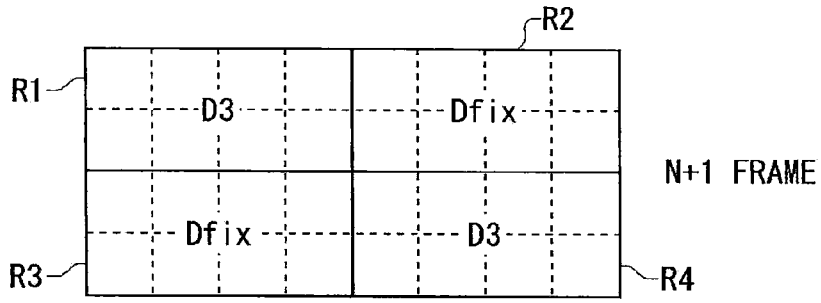
Figure 5C:
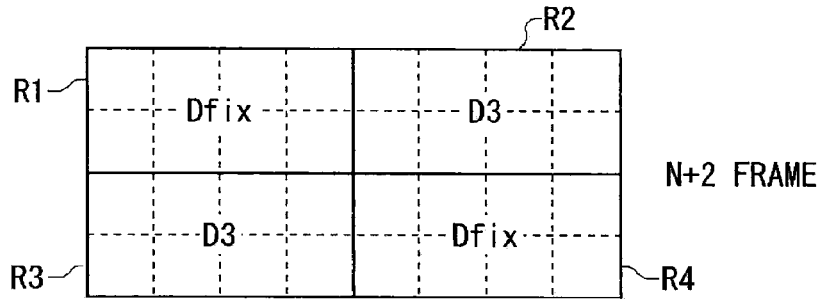
Figure 5D:
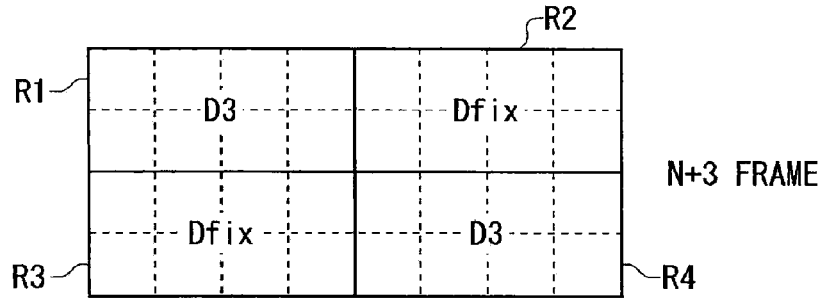

FIG. 4 is a diagram showing relationships of various data in the display control device 100*a* and the input data D_IN. A horizontal axis (x-axis) of FIG. 4 represents values of m=8-bit input data D_IN, and a vertical axis (y-axis) represents brightness that is expressed in a simulated manner by each of n=6-bit data D_OUT, D1, D2, and D3. Moreover, in order to facilitate understanding, the vertical axis and the horizontal axis are enlarged or contracted as appropriate. FIG. 4 shows the first tone data D1 and the second tone data D2 that have different rates of change with respect to the input data D_IN.

In a conventional circuit configuration, since the output data D_OUT=the first tone data D1, the output data D_OUT has a constant value of 252 with respect to a range of the input data D_IN=252 to 255, and an 8-bit portion of the data could not be represented. In contrast to this, according to the display control device 100 of FIG. 1, in a range of 249≦D_IN≦255, by switching to the second tone data D2 that has a different rate of change, it is possible to change level of the output data D_OUT according to the input data D_IN. That is, in the present embodiment, in all ranges of all the input data it is possible to change brightness represented by the output data.

Below, an explanation will be given concerning a specific configuration example of the display control device 100 of FIG. 1.

Figure 3:
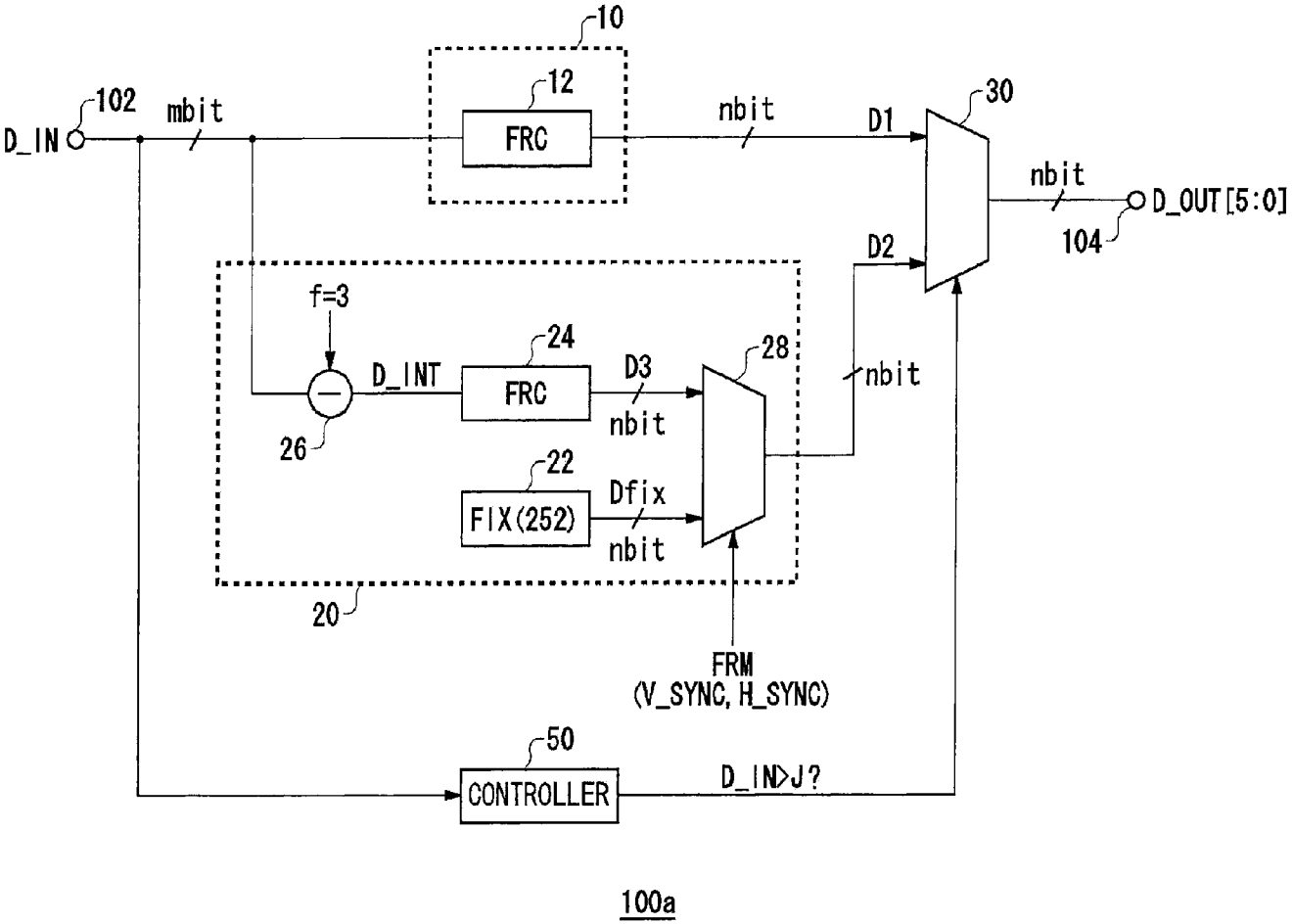
FIG. 3 is a block diagram showing a first configuration example of the display control device of FIG. 1.

FIG. 3 is a block diagram showing a first configuration example of the display control device of FIG. 1. In the display control device 100*a* of FIG. 3, the first frame rate controller 10 generates the first tone data D1 so that the rate of change of the brightness represented by the first tone data D1 with respect to the input data D_IN is 1. On the other hand, the second frame rate controller 20 generates the second tone data D2 so that the rate of change of the brightness represented by the second tone data D2 with respect to the input data D_IN is less than 1.

The first frame rate controller 10 includes a first frame rate control circuit 12. The first frame rate control circuit 12 generates $2^k$ (=4) items of the first tone data D1[0-3] obtained by the upper n bits of the input data D_IN being adjusted, according to values of the lower k (=m−n=2) bits of the input data D_IN. The first frame rate control circuit 12 performs output in a time division manner, with $2^k$ (=4) times as 1 cycle.

As an example, the first frame rate control circuit 12 provides a first bit sequence b1 formed by the upper n bits of the input data D_IN and a second bit sequence b2 obtained by 1 is added to the first bit sequence b1. When values of the lower k (=2) bits of the input data D_IN are taken as a decimal number h (=0-3), among D1[0-3], h items are taken as the second bit sequence b2 and the remainder ($2^k$-h) as the first bit sequence b1.

If a specific numerical value is taken as an example, when the upper n bits of the input data D_IN are 111100, the first bit sequence b1 is 111100, and the second bit sequence b2 is 1 added to this, 111101. At this time, if the lower k (=2) bits of the input data D_IN are 00, since h=0, all of the first tone data D1[0-3] become the first bit sequence b1=111100.

If the lower 2 bits of the input data D_IN are 01, since h=1, any one of the first tone data D1[0-3] becomes the second bit sequence b2, and the remaining three become the first bit sequence b1.

If the lower 2 bits of the input data D_IN are 10, since h=2, among the first tone data D1[0-3], two become the second bit sequence b2, and the remaining two become the first bit sequence b1.

If the lower 2 bits of the input data D_IN are 11, since h=3, among the first tone data D1[0-3], three become the second bit sequence b2, and the remaining one becomes the first bit sequence b1.

Furthermore, when the upper n bits are 111111, it is not possible to add 1 thereto. Therefore, in all cases in which the lower 2 bits are 00, 01, 11, and 10, D1[0]=D1[1]=D1[2]=D1[3]=111111. That is, when the frame rate control is used, it is possible to represent brightness levels of 253 tones from 0 to $2^8-4=256-4=252$. Generalizing further, the largest number of tones that can be represented by the frame rate control is, using m and k, $2^m-2^k+1$.

The second frame rate controller 20 includes a fixed data generator 22, a second frame rate control circuit 24, a subtractor 26, and a selector 28.

The fixed data generator 22 generates $2^k$ items of n-bit fixed data, representing the first predetermined value d (d is an integer), and outputs the $2^k$ items of n-bit fixed data in a time division manner with $2^k$ times as a cycle. In the present embodiment, $d=2^m-2^k=252$. The $2^k$ (=4) items of n (=6)-bit fixed data Dfix representing the first predetermined value d=252 are formed of a bit sequence in which all bits are 1. That is, Dfix[0]=Dfix[1]=Dfix[2]=Dfix[3]=111111. The fixed data generator 22 outputs Dfix (=111111) at each predetermined first timing.

The subtractor 26 performs a predetermined operation on the input data D_IN, and generates intermediate data D_INT. In the present embodiment, the predetermined operation is addition or subtraction of a second predetermined value f (f is an integer). More specifically, this is subtraction of the second predetermined value $f=2^k-1=3$.

The second frame rate control circuit 24 generates $2^k$ items of the third tone data D3 obtained by the upper n bits of the intermediate data D_INT being adjusted, according to values of the lower k (=2) bits of the intermediate data D_INT, and outputs the $2^k$ items of the third tone data D3 in a time division manner with $2^k$ times as 1 cycle. That is, the second frame rate control circuit 24 has a capability similar to the first frame rate control circuit 12.

The selector 28 receives the third tone data D3[0-3] from the second frame rate control circuit 24, and the fixed data Dfix[0-3] from the fixed data generator 22, and switches the received data in a time division manner, to be outputted as the second tone data D2.

The selector 28 alternately switches the third tone data D3 and the fixed data Dfix, at each predetermined second timing. The second timing is prescribed by a frame signal FRM. That is, in the present embodiment, the third tone data D3 and the fixed data Dfix are switched for each 1 frame.

In the display control device 100*a* of FIG. 3, the controller 50 compares values of the input data D_IN with a predetermined threshold $J=(2^m-2\times2^k+1=249)$, selects the first tone data D1 when D_IN≦J, and selects the second tone data D2 when D_IN>J.

Operation of the display control device 100*a* of FIG. 3 configured as above will be explained referring to FIG. 4.

In the display control device 100*a* of FIG. 3, the first tone data D1 outputted from the first frame rate controller 10 increases at a rate of change g1=1 with respect to the input data D_IN, and when D_IN=252, is saturated. With respect to the input data D_IN=252 to 255, the first tone data D1 has a constant value of 252. This point has already been described.

That is, $$y=x \tag{1}$$

holds, with regard to the first tone data D1.

In the display control device 100*a* of FIG. 3, the second tone data D2 outputted from the second frame rate controller 20 increases at a rate of change g2=0.5 with respect to the input data D_IN, and is a straight line passing through (x, y)=(255, 252). That is, $$y=0.5(x-255)+252 \tag{2}$$

holds, with regard to the second tone data D2. This second tone data D2 is generated in the following way.

In the second frame rate controller 20, the second frame rate control circuit 24, performs frame rate control processing with respect to intermediate data obtained by 3 being subtracted from the input data D_IN. Therefore, the third tone data D3 that is output of the second frame rate control circuit 24 is a straight line with a rate of change of 1, obtained by the first tone data D1 being shifted by 3 in the x-axis (horizontal axis) direction. That is, $$y=x-3 \tag{3}$$

holds, with regard to the third tone data D3.

The brightness represented by the fixed data Dfix from the fixed data generator 22 is $$y=252 \tag{4}$$

as described above. The selector 28 alternately switches the third tone data D3 and the fixed data Dfix, based on a frame signal. Therefore the brightness represented by a time average of the second tone data D2 is an average value of Dfix and D3. That is, $$D2=(D\text{fix}+D3)/2 \tag{5}$$

holds. If expressions (3) and (4) are substituted into expression (5), expression (2) is obtained.

In this way, according to the display control device 100*a* of FIG. 3, by switching different brightness data in a time division manner, the second tone data D2 with a gradient less than 1 is generated, and it is possible to represent an intermediate tone.

Furthermore, in the display control device 100*a* of FIG. 3, the second frame rate controller 20 may divide a plurality of pixels arrayed in a matrix form into a plurality of regions, and may be set to shift a phase of switching of the third tone data D3 and the fixed data Dfix for each region.

FIGS. 5A to 5D are diagrams showing operation of the second frame rate controller 20 of each pixel region. FIGS. 5A to 5D show a portion of the plurality of pixels arrayed in a matrix, and show a state of the selector 28 between 4 continuous frames.

FIGS. 5A to 5D show 4 by 8 vertical-horizontal pixels, and the plurality of pixels is divided into regions of 2 vertical by 4 horizontal regions, R1 to R4.

Focusing on pixels inside the first region R1 and the fourth region R4, the selector 28 selects the fixed data Dfix in even numbered frames N and N+2, and selects the third tone data D3 in odd-numbered frames N+1, N+3.

On the other hand, focusing on pixels inside the second region R2 and the third region R3, the selector 28 selects the third tone data D3 in even numbered frames N and N+2, and selects the fixed data Dfix in odd-numbered frames N+1, N+3.

That is, some regions R1 and R4 have the third tone data D3 and the fixed data Dfix switched at a different phase (opposite phase) to adjacent regions R2 and R3. By using this method, by the brightness of adjacent regions being averaged, it is possible to represent intermediate brightness. Furthermore, when this processing is performed, the selector 28 may switch the third tone data D3 and the fixed data Dfix based on a horizontal synchronization signal H_SYNC and a vertical synchronization signal V_SYNC, in addition to the frame signal FRM.

Figure 6:
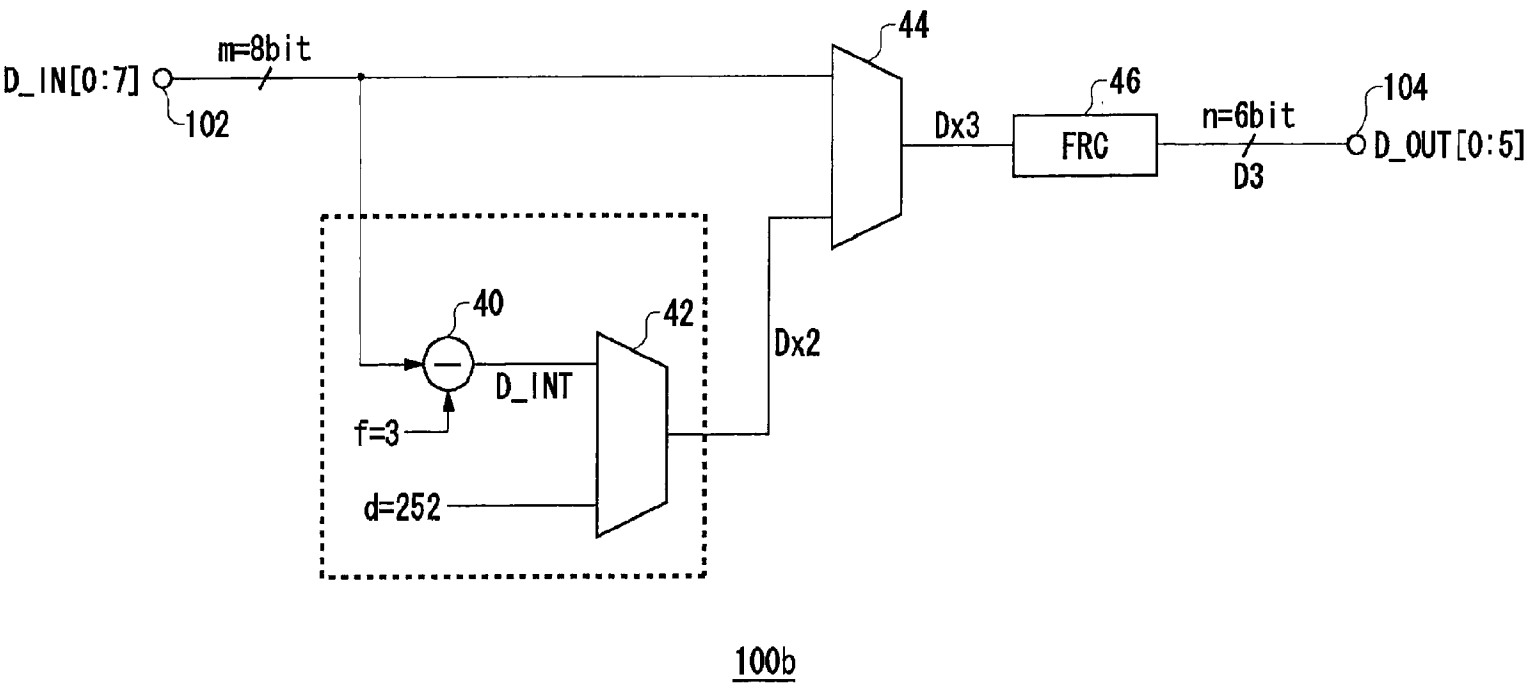
FIG. 6 is a block diagram showing a second configuration example of the display control device of FIG. 1.

FIG. 6 is a block diagram showing a second configuration example of the display control device of FIG. 1. The display control device 100*b* of FIG. 6 is provided with an intermediate data generator 40, selectors 42 and 44, and a frame rate control circuit 46.

The intermediate data generator 40 generates the intermediate data D_INT, obtained by a predetermined operation being carried out on the input data D_IN. The predetermined operation is, for example, subtraction of the second predetermined value f. As described above, f may be set as f=3.

A selector 42 outputs a first predetermined value d (for example, d=252) and the intermediate data D_INT in a time division manner. The selector 42 performs switching similarly to the selector 28 of FIG. 3.

The input data D_IN and output data Dx2 of the selector 42 are inputted to the selector 44, and either one thereof is selected and outputted as third data Dx3. The selector 44 is controlled based on the values of the input data D_IN similarly to the selector 30 of FIG. 3. For example, the selector 44 selects the input data D_IN when D_IN≦J, and selects the output data Dx2 of the selector 42 when D_IN>J.

The frame rate control circuit 46 generates a plurality of third tone data D3 obtained by the upper n bits of the third data Dx3 being adjusted, according to values of the lower k bits of the third data Dx3, and outputs the generated data in a time division manner at each predetermined first timing. The frame rate control circuit 46 corresponds to the first frame rate control circuit 12 and the second frame rate control circuit 24 of FIG. 1.

The display control device 100*b* of FIG. 6 is a circuit in which order of signal processing is switched from the display control device 100*a* of FIG. 3. That is, in the display control device 100*a* of FIG. 3, the configuration is such that the tone data is generated by the frame rate control circuit, and the tone data is switched by the selector. In contrast to this, in the display control device 100*b* of FIG. 6, in pre-processing of the frame rate control circuit, data is switched by a selector.

When the input data D_IN is inputted to the frame rate control circuit 46, the circuit of FIG. 6 functions as the first frame rate controller 10 of FIG. 3. Furthermore, when the output data Dx2 of the selector 42 is inputted to the frame rate control circuit 46, it operates as the second frame rate controller 20 of FIG. 3.

According to the display control device 100*b* of FIG. 6, a function the same as display control device 100*a* of FIG. 3 can be realized by a single frame rate control circuit.

In the display control device 100*b* of FIG. 6 also, as shown in FIG. 5, pixels may be spatially divided and phase may be shifted for each region. In such cases, in addition it is possible to represent the intermediate tones by average brightness of adjacent plural pixels.

The embodiment is an example, and a person skilled in the art will understand that various modified examples in combinations of various component elements and various processes thereof are possible, and that such modified examples are within the scope of the present invention.

Figures 7, 8:
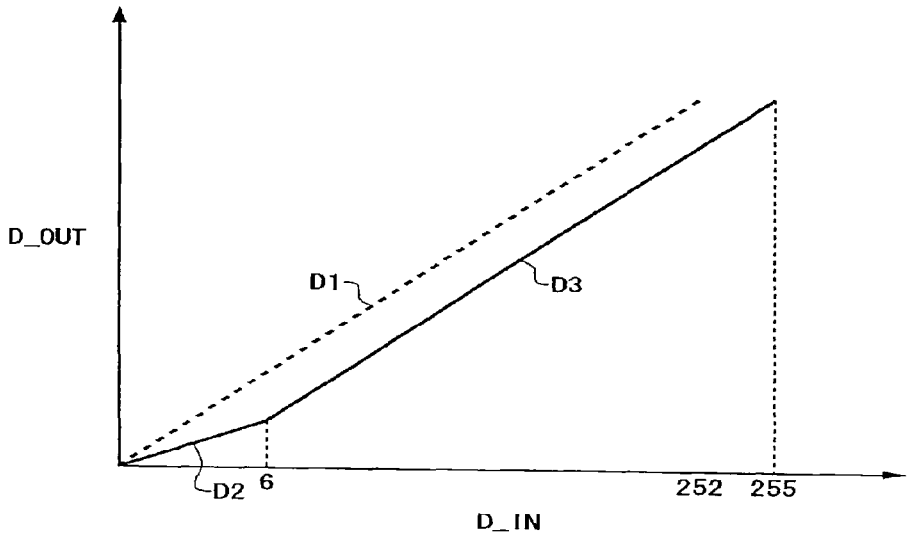
FIG. 7 is a diagram showing a modified example of an input-output characteristic of FIG. 4.
FIG. 8 is a table showing an input-output characteristic of the second frame rate controller according to the modified example.

An input-output characteristic of FIG. 4 explained in the embodiment is an example, and other modified examples are included in the scope of the present invention. FIG. 7 shows a modified example of the input-output characteristic of FIG. 4. The input-output characteristic of FIG. 7 can be obtained in the following manner.

The first predetermined value d is set as d=0. Bits of the fixed data Dfix[0]-[3] that represent 0 are all 0. The second tone data D2 is an average of the fixed data Dfix and the first tone data D1. Furthermore, a setting of J=6 is performed. The selector 30 selects the second tone data D2 when D_IN<J, and selects the third tone data D3 when D_IN≧J.

In other cases also, by switching an arbitrary plurality of tone data in a time division manner, representation of intermediate tones is possible, and such modified examples are also included in the scope of the invention.

The switching in a time division manner is not limited to 2 sets of tone data, and 3 sets or more of tone data may be switched in a time division manner. Furthermore, in the embodiment an explanation has been given concerning cases in which the switching timing is set for each frame, but switching may also be performed for each of a plurality of frames.

Furthermore, in the embodiment an explanation has been given concerning cases in which a time ratio of the time division is 50%, but a different time ratio may also be used. For example, in the circuit of FIG. 3, the selector 28 may select the third tone data D3 during 3 frames, and may select the fixed data Dfix during 1 frame. In such cases, it is possible to more finely set the rate of change of the brightness represented by the tone data, with respect to the input data.

Next, an explanation is given concerning a modified example of the second frame rate controller. The second frame rate controller 20*a* represents intermediate tones by changing appearance frequency of a first fixed value DfixA and a second fixed value DfixB, according to the input data D_IN. The appearance frequency is either spatial (according to area) or temporal, or a combination of the two. The first fixed value DfixA is equal to 62, by 6-bit conversion (248, by 8-bit conversion), and the second fixed value DfixB is equal to 63, by 6-bit conversion (252, by 8-bit conversion).

FIG. 8 is a table showing an input-output characteristic of the second frame rate controller 20*a* according to the modified example. When tones of the input data D_IN are in a range of 250 or greater, the second frame rate controller 20*a* sets pixel brightness according to appearance ratio of the 6-bit conversion brightness 62 and brightness 63 that have been set.

For example, in cases in which spatial control is performed, the frame rate controller divides a plurality of pixels arrayed in a matrix form into a plurality of regions, and sets the brightness of each pixel included in each of the regions. The second frame rate controller 20*a* sets average brightness of the entire region to tones corresponding to the input data D_IN, by changing the appearance ratio of the first fixed value DfixA (=62) and the second fixed value DfixB (=63).

For example, when the input data D_IN=252, a ratio of 3:5 is used, that is, among 8 pixels the first fixed value DfixA (=62) is outputted to 3 pixels, and the second fixed value DfixB (=63) is outputted to the remaining 5 pixels.

In cases in which temporal control only is performed, the brightness of each pixel is set with 8 continuous frames as a unit. For example, when the input data D_IN=252, a ratio of 3:5 is used, that is, among 8 frames the first fixed value DfixA (=62) is outputted to 3 frames, and the second fixed value DfixB (=63) is outputted to the remaining 5 frames.

In cases in which it is not desirable for a certain pixel to be lit up for a continuous time at the same brightness, temporal control may be combined with spatial control. That is, a spatial and temporal average value of the appearance ratio of the brightness 62 and the brightness 63 may be set to a value prescribed in FIG. 8. In cases in which tone control is performed with 8 pixels and 8 frames as a unit, an appearance ratio of the brightness 62 and the brightness 63 is set for 8×8 pixels overall.

Figure 9:
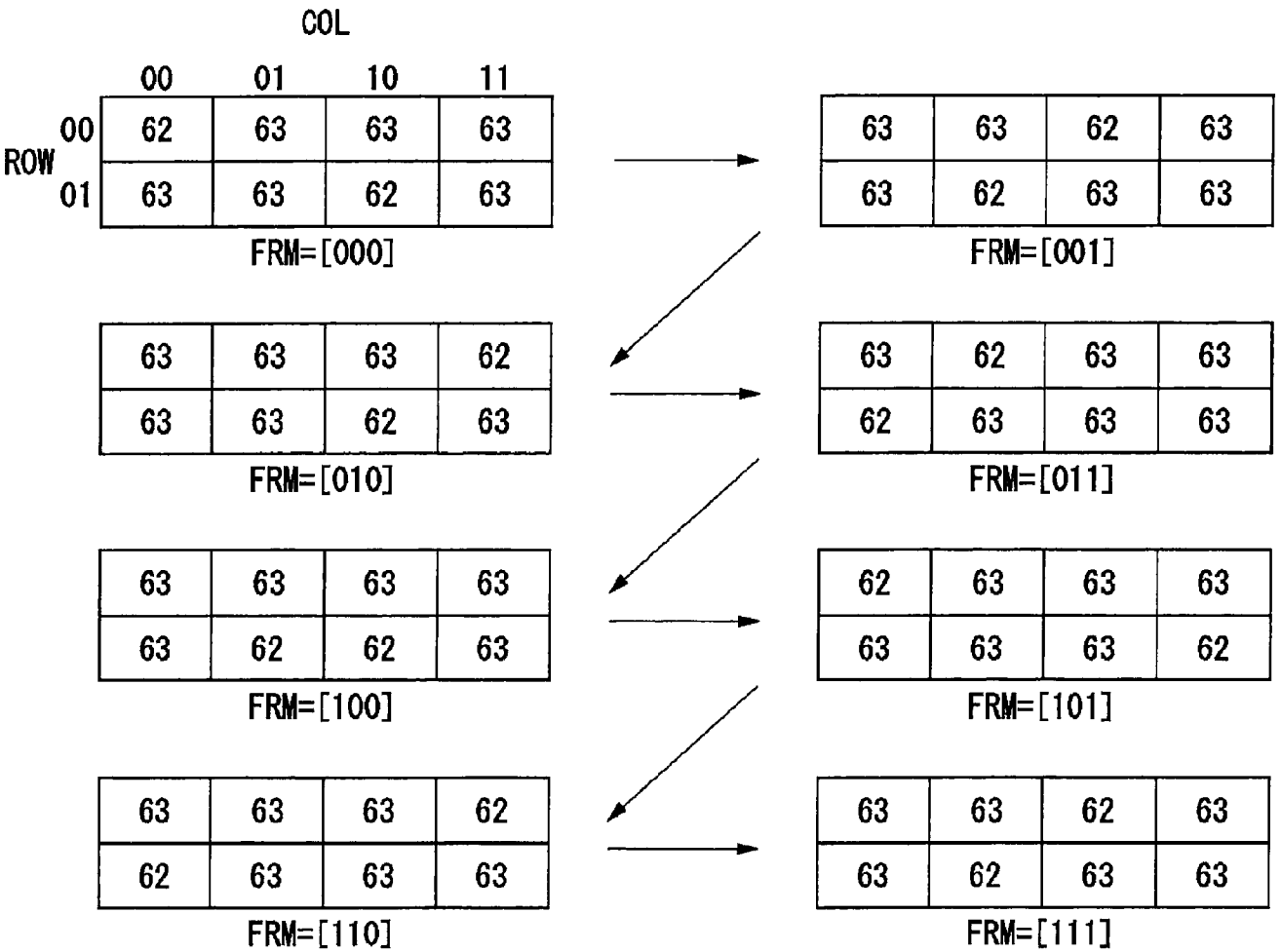
FIG. 9 is a diagram showing an aspect of temporal and spatial brightness control by the second frame rate controller according to the modified example.

FIG. 9 is a diagram showing an aspect of temporal and spatial brightness control by the second frame rate controller 20*a* according to the modified example. In FIG. 9, when the input tones are 253, the appearance frequency of the brightness 62 and the brightness 63 is set to 2:6. Positions of a pixel set to the brightness 62 and a pixel set to the brightness 63 are not fixed spatially, and it is desirable to carry out movement in a pseudo-random manner based on a rule set in advance.

Figure 10:
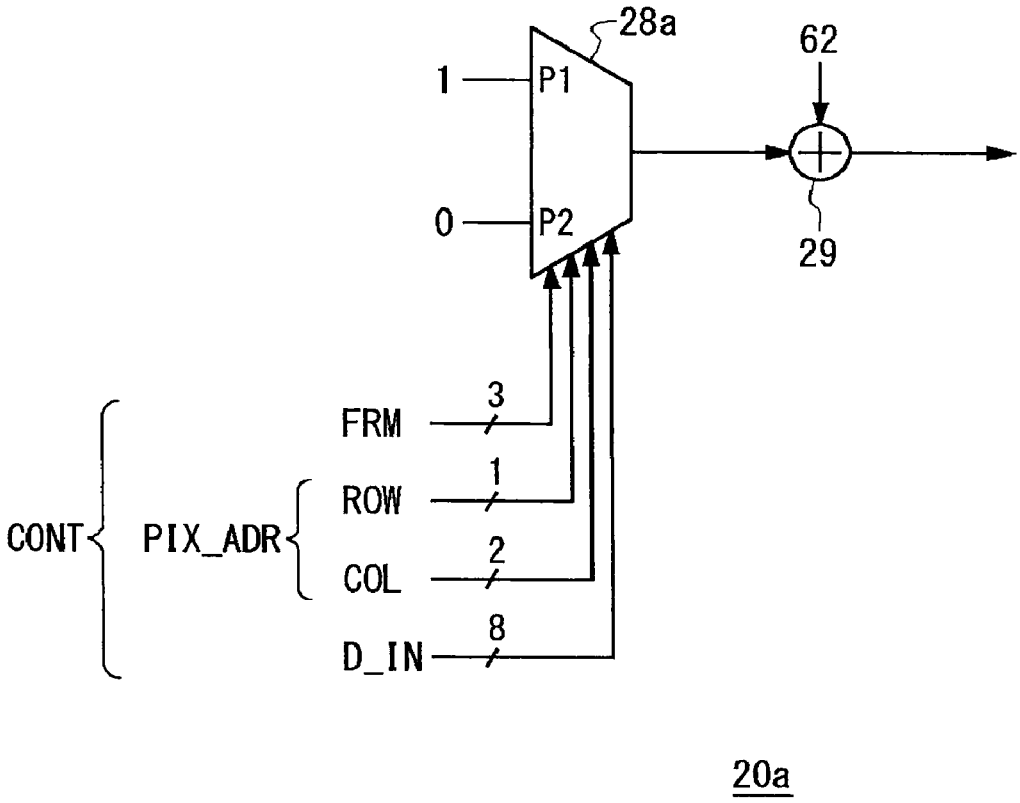
FIG. 10 is a circuit diagram showing a configuration of the second frame rate controller according to the modified example.

FIG. 10 is a circuit diagram showing a configuration of the second frame rate controller 20*a* according to the modified example. The second frame rate controller 20*a* is provided with a selector 28*a* and an adder 29. "1" is inputted to a first input terminal P1 of the selector 28*a*, and "0" is inputted to a second input terminal P2. Input data D_IN, a 3-bit address signal ADR indicating a position of a pixel within a pixel region, and a 3-bit frame signal FRM as a control signal CONT are inputted to the selector 28*a*. The address signal ADR may include a 1-bit row address signal ROW and a 2-bit column address signal COL. The 3 bits of the frame signal mean that the brightness is set with 8 frames as a unit. Furthermore, the 3-bit address signal ADR means that the brightness is set with 8 pixels as a unit. The 1-bit row address signal ROW means that a pixel region has 2 rows, and the 2-bit column address COL means that the pixel region has 4 columns.

The selector 28*a* selects either "1" of the first input terminal P1 or "0" of the second input terminal P2, according to a value of a control signal of 14 bits in total. A selection rule of the selector 28*a* is held in a table (memory) in advance, so that the appearance frequency of the brightness 62 and the brightness 63 shown in FIG. 8 is satisfied. Instead of using the table, the selector 28*a* may perform the selection based on a result of an operation on each bit of the control signal CONT. The selection rule may be according to the abovementioned temporal processing, may be according to the spatial processing, or may be according to a combination thereof.

The adder 29 adds output of the selector 28*a* and a predetermined value 62. As a result thereof, the output of the second frame rate controller 20*a* has a value of either of the brightness 62 or the brightness 63, according to the value of the 14-bit control signal CONT.

Furthermore, instead of providing the adder 29, the brightness 62 may be inputted to the first input terminal P1 of the selector 28*a*, and the brightness 63 may be inputted to the second input terminal P2.

In cases in which the brightness is set with a pixel region as a unit as shown in FIG. 5, since the brightness is different of each pixel region, a problem occurs in that horizontal stripes or vertical stripes can be seen, depending on the person. In response to this, if the processing of the second frame rate controller 20*a* according to the modified example is adopted, it is possible to curtail the horizontal stripes or vertical stripes.

While the preferred embodiments of the present invention have been described using specific terms, such description is for illustrative purposes only, and it is to be understood that changes and variations may be made without departing from the spirit or scope of the appended claims.

The invention claimed is:

1. A display control device which uses frame rate control and converts m-bit input data, m being an integer, representing brightness of each pixel, to n-bit output data, n being an integer less than m, to control brightness of each pixel, the device comprising:

a first frame rate controller which uses frame rate control, generates a plurality of first tone data according to the input data, and outputs the generated data in a time division manner at each predetermined first timing; and a second frame rate controller which uses frame rate control, generates a plurality of second tone data according to the input data, and outputs the generated data in a time division manner at each predetermined first timing; wherein rate of change of brightness represented by the first tone data with respect to the input data and rate of change of brightness represented by the second tone data with respect to the input data are made different, and any of the first and the second tone data from the first and the second frame rate controllers is selected, to control brightness of each pixel, wherein the second frame rate controller comprises:

a fixed data generator which generates $2^k$ items of n-bit fixed data, representing a first predetermined value d, d being an integer, and outputs the generated data in a time division manner with $2^k$ times as 1 cycle;

a second frame rate control circuit which generates $2^k$ items of third tone data obtained by upper n bits of intermediate data being adjusted, according to a value of lower k bits of the intermediate data obtained by a predetermined operation being carried out on the input data, and outputs the generated data in a time division manner with $2^k$ times as 1 cycle; and a selector which receives third tone data from the second frame rate control circuit and fixed data from the fixed data generator, switches the received data in a time division manner, to be outputted as the second tone data, and wherein the second frame rate controller divides a plurality of pixels arrayed in a matrix form into a plurality of regions, and sets a phase for switching the third tone data and the fixed data for each region.

2. A display control device according to claim 1, wherein any of the first and the second tone data from the first and the second frame rate controllers is selected according to a relationship of a value of the input data and a predetermined threshold.

3. A display control device according to claim 1, wherein the first timing is prescribed by a frame signal.

4. A display control device according to claim 1, wherein the first frame rate controller generates the first tone data so that rate of change of brightness represented by the first tone data with respect to the input data is 1, and the second frame rate controller generates the second tone data so that rate of change of brightness represented by the second tone data with respect to the input data is less than 1.

5. A display control device according to claim 1, wherein the first frame rate controller includes a first frame rate control circuit which generates $2^k$ items of first tone data, obtained by upper n bits of the input data being adjusted, according to a value of lower k bits of the input data, and outputs the generated data in a time division manner with $2^k$ times as 1 cycle.

6. A display control device according to claim 1, wherein the predetermined operation is addition or subtraction of a second predetermined value f (f is an integer).

7. A display control device according to claim 6, wherein the second predetermined value is $f=2^k-1$.

8. A display control device according to claim 1, wherein the first predetermined value d is $d=2^m-2^k$, and all bits in the $2^k$ items of n-bit fixed data are 1.

9. A display control device according to claim 1, wherein, with m=8, n=6, and k=2, and the first predetermined value d=252, the predetermined operation is subtraction of the second predetermined value f=3.

10. A display control device according to claim 1, wherein the selector alternately switches the third tone data and the fixed data, at each predetermined second timing.

11. A display control device according to claim 10, wherein the second timing is prescribed by a frame signal.

12. A display control device according to claim 1, wherein the first and the second frame rate controllers are configured to share:

an intermediate data generator which generates intermediate data obtained by a predetermined operation being carried out on the input data;

a selector which outputs a first predetermined value d (d is an integer) and the intermediate data in a time division manner; and one frame rate control circuit to which either one of the input data or the output data of the selector are inputted as third data, to generate a plurality of third tone data, obtained by upper n bits of the third data being adjusted, according to a value of lower k bits of the third data, and to output the generated data in a time division manner at each predetermined first timing; wherein operation is performed as the first frame rate controller when the input data is inputted to the frame rate control circuit, and as the second frame rate controller when output data of the selector is inputted to the frame rate control circuit.

13. A display control device according to claim 12, wherein the predetermined operation is addition or subtraction of a second predetermined value f, f being an integer.

14. A display control device according to claim 13, wherein the second predetermined value is $f=2^k-1$.

15. A display control device according to claim 12, wherein the first predetermined value d is $d=2^m-2^k$.

16. A display control device according to claim 12, wherein, with m=8, n=6, and k=2, and the first predetermined value d=252, the predetermined operation is subtraction of the second predetermined value f=3.

17. A display control device according to claim 1, wherein the display control device is integrated as a unit on one semiconductor substrate.

18. An electronic device comprising:

a display panel;

a driver circuit which drives the display panel;

a signal processor which generates image data to be displayed on the display panel with m bits for each color; and the display control device according to claim 1, which receives the m-bit image data and outputs n-bit output data to the driver circuit.

19. A display control device which uses frame rate control and converts m-bit input data (m is an integer) representing brightness of each pixel, to n-bit output data (n is an integer, n<m), to control brightness of each pixel, the device comprising:

a first frame rate controller which uses frame rate control, generates a plurality of first tone data according to the input data, and outputs the generated data in a time division manner at each predetermined first timing; and a second frame rate controller which uses frame rate control, generates a plurality of second tone data according to the input data, and outputs the generated data in a time division manner at each predetermined first timing; wherein rate of change of brightness represented by the first tone data with respect to the input data and rate of change of brightness represented by the second tone data with respect to the input data are made different, and any of the first and the second tone data from the first and the second frame rate controllers is selected, to control brightness of each pixel, wherein the first and the second frame rate controllers are configured to share:

an intermediate data generator which generates intermediate data obtained by a predetermined operation being carried out on the input data;

a selector which outputs a first predetermined value d (d is an integer) and the intermediate data in a time division manner; and one frame rate control circuit to which either one of the input data or the output data of the selector are inputted as third data, to generate a plurality of third tone data, obtained by upper n bits of the third data being adjusted, according to a value of lower k bits of the third data, and to output the generated data in a time division manner at each predetermined first timing; wherein operation is performed as the first frame rate controller when the input data is inputted to the frame rate control circuit, and as the second frame rate controller when output data of the selector is inputted to the frame rate control circuit.

20. A display control device according to claim 19, wherein the predetermined operation is addition or subtraction of a second predetermined value f (f is an integer).

21. A display control device according to claim 19, wherein the second predetermined value is $f=2^k-1$.

22. A display control device according to claim 19, wherein the first predetermined value d is $d=2^m-2^k$.

23. A display control device according to claim 19, wherein, with m=8, n=6, and k=2, and the first predetermined value d=252, the predetermined operation is subtraction of the second predetermined value f=3.

24. A display control device according to claim 19, wherein the display control device is integrated as a unit on one semiconductor substrate.

25. An electronic device comprising:

a display panel;

a driver circuit which drives the display panel;

a signal processor which generates image data to be displayed on the display panel with m bits for each color; and the display control device according to claim 19, which receives the m-bit image data and outputs n-bit output data to the driver circuit.

26. A display control device according to claim 19, wherein any of the first and the second tone data from the first and the second frame rate controllers is selected according to a relationship of a value of the input data and a predetermined threshold.

27. A display control device according to claim 19, wherein the first timing is prescribed by a frame signal.

28. A display control device according to claim 19, wherein the first frame rate controller generates the first tone data so that rate of change of brightness represented by the first tone data with respect to the input data is 1, and the second frame rate controller generates the second tone data so that rate of change of brightness represented by the second tone data with respect to the input data is less than 1.

29. A display control device according to claim 19, wherein the first frame rate controller includes a first frame rate control circuit which generates $2^k$ items of first tone data, obtained by upper n bits of the input data being adjusted, according to a value of lower k bits of the input data, and outputs the generated data in a time division manner with $2^k$ times as 1 cycle.

30. A display control device according to claim 19, wherein the second frame rate controller comprises:

a fixed data generator which generates $2^k$ items of n-bit fixed data, representing a first predetermined value d (d is an integer), and outputs the generated data in a time division manner with $2^k$ times as 1 cycle;

a second frame rate control circuit which generates $2^k$ items of third tone data obtained by upper n bits of intermediate data being adjusted, according to a value of lower k bits of the intermediate data obtained by a predetermined operation being carried out on the input data, and outputs the generated data in a time division manner with $2^k$ times as 1 cycle; and a selector which receives third tone data from the second frame rate control circuit and fixed data from the fixed data generator, switches the received data in a time division manner, to be outputted as the second tone data.

31. A display control device according to claim 30, wherein the predetermined operation is addition or subtraction of a second predetermined value f (f is an integer).

32. A display control device according to claim 31, wherein the second predetermined value is $f=2^k-1$.

33. A display control device according to claim 30, wherein the first predetermined value d is $d=2^m-2^k$, and all bits in the $2^k$ items of n-bit fixed data are 1.

34. A display control device according to claim 30, wherein, with m=8, n=6, and k=2, and the first predetermined value d=252, the predetermined operation is subtraction of the second predetermined value f=3.

35. A display control device according to claim 30, wherein the selector alternately switches the third tone data and the fixed data, at each predetermined second timing.

36. A display control device according to claim 35, wherein the second timing is prescribed by a frame signal.

37. A display control device according to claim 30, wherein the second frame rate controller divides a plurality of pixels arrayed in a matrix form into a plurality of regions, and sets a phase for switching the third tone data and the fixed data for each region.

* * * * *